US008899773B2

(12) United States Patent
Levine et al.

(10) Patent No.: US 8,899,773 B2
(45) Date of Patent: Dec. 2, 2014

(54) MENU VISION AID AND METHODS THEREOF

(71) Applicants: David Levine, Manalapan, NJ (US); Gene Uhlig, Colonia, NJ (US); Joseph A. Calenda, Colonia, NJ (US)

(72) Inventors: David Levine, Manalapan, NJ (US); Gene Uhlig, Colonia, NJ (US); Joseph A. Calenda, Colonia, NJ (US)

( * ) Notice: Subject to any disclaimer, the term of this patent is extended or adjusted under 35 U.S.C. 154(b) by 159 days.

(21) Appl. No.: 13/719,444

(22) Filed: Dec. 19, 2012

(65) Prior Publication Data

US 2014/0168950 A1 Jun. 19, 2014

(51) Int. Cl.

| | |
|---|---|
| ***A47B 19/00*** | (2006.01) |
| ***G09F 13/00*** | (2006.01) |
| ***B42F 3/00*** | (2006.01) |

(52) U.S. Cl.

CPC .. *B42F 3/00* (2013.01); *G09F 13/00* (2013.01)

USPC ..... 362/98; 362/458

(58) Field of Classification Search

USPC ..... 362/98–99, 457–458

See application file for complete search history.

(56) References Cited

U.S. PATENT DOCUMENTS 8,540,388 B1 * 9/2013 Chen ..... 362/98

* cited by examiner

*Primary Examiner* — Jason Moon Han

(74) *Attorney, Agent, or Firm* — Jon Fallon, Esq.; Michael P. Kochka, Esq.

(57) ABSTRACT

Embodiments of the present disclosure generally relate to a menu vision aid. In one embodiment, a menu vision aid comprises a frame, a lens disposed within the frame adapted to enhance the visibility of a menu page, a light source attached to the frame adapted to provide light to a menu page; and an attachment member attached to at least one of the frame and the light source, the attachment member adapted to attach the menu vision aid to a menu page.

19 Claims, 5 Drawing Sheets

MENU VISION AID AND METHODS THEREOF

BACKGROUND

1. Field of the Invention

Embodiments of the present disclosure generally relate to a menu vision aid. More specifically, embodiments of the present disclosure relate to a menu vision aid that may attach to a menu and improve its visibility.

2. Description of the Related Art

Restaurants and other businesses often use menus to present food and beverage offering options to patrons. Menus are often printed in book form with offerings listed directly on multiple pages. Menus can also be presented on interchangeable sheets of paper secured within a binder or hard-backed folder. Interchangeable paper menus are often used to allow restaurants to modify the menu to reflect the most current offerings, which may change on a daily basis or even multiple times in a day. Because restaurants can offer a large number of food and beverage options, the text and images on menus must sometimes be small to maximize the space on menu pages and to avoid presenting the user with a bulky menu. One downside to using small text is that it is often hard to read for patrons, especially those who are visually impaired. To add to this problem, restaurants and other businesses are often dimly lit, making it even more difficult for patrons to view the menus.

As a solution, many patrons use reading glasses to read these menus. Because the patrons often forget their reading glasses at home, however, many times they are still unable to read the menus. Another solution for these patrons is bringing in a traditional magnifying glass. These magnifying glasses are often bulky and difficult to transport, however. In addition, magnifying glasses do not enhance the menu lighting at all, so the menus would still be difficult to read in dimly lit environments.

Thus, there is a need for a menu vision aid that may attach to a menu so that businesses may offer the vision aid to patrons and the patrons will not forget the vision aids at home. In addition, there is a need for a menu vision aid that both magnifies and illuminates menus.

SUMMARY

Embodiments of the present disclosure generally relate to a menu vision aid. More specifically, embodiments of the present disclosure relate a menu vision aid that may have a lens and a light.

In one embodiment of the present disclosure, a menu vision aid may comprise a frame, a lens disposed within the frame adapted to enhance the visibility of a menu page, a light source attached to the frame adapted to provide light to a menu page, and an attachment member attached to at least one of the frame and the light source, the attachment member adapted to attach the menu vision aid to a menu page.

In another embodiment of the present disclosure, a menu may be provided comprising a menu page, a fastening member secured to the menu page, and a vision aid attached to the fastening member, the vision aid comprising a frame, a lens disposed within the frame adapted to enhance the visibility of the menu page, a light source attached to the frame adapted to provide light to the menu page, and an attachment member attached to at least one of the frame and the light source, the attachment member adapted to attach the menu vision aid to the fastening member.

In another embodiment of the present disclosure, a method for viewing a menu may comprise providing menu vision aid that may comprise a frame, a lens disposed within the frame adapted to enhance the visibility of a menu page, a light source attached to the frame adapted to provide light to a menu page, and an attachment member attached to at least one of the frame and the light source, the attachment member adapted to attach the menu vision aid to a menu page; attaching the menu vision aid to a menu page; positioning the lens over at least a portion of the menu page; and viewing the menu.

BRIEF DESCRIPTION OF THE DRAWINGS

So the manner in which the above recited features of the present disclosure can be understood in detail, a more particular description of embodiments of the present disclosure, briefly summarized above, may be had by reference to embodiments, which are illustrated in the appended drawings. It is to be noted, however, the appended drawings illustrate only typical embodiments of embodiments encompassed within the scope of the present disclosure, and, therefore, are not to be considered limiting, for the present disclosure may admit to other equally effective embodiments, wherein.

Figure 1:
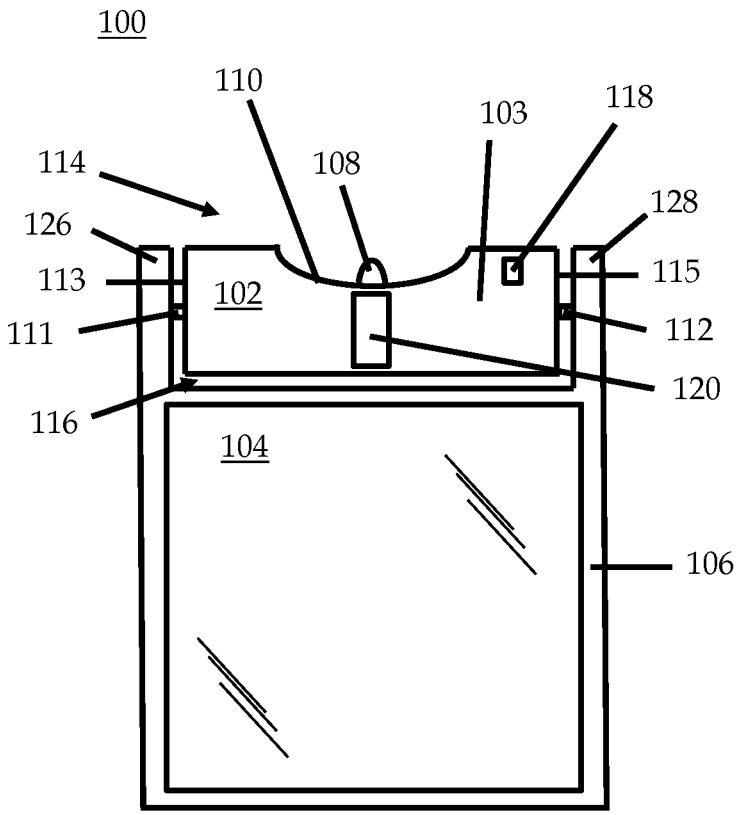
FIG. 1 depicts a front view of a menu vision aid in accordance with embodiments of the present disclosure.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present disclosure generally relate to a menu vision aid. More specifically, embodiments of the present disclosure relate to a menu vision aid having a lens and a light source and methods of operating the same. Embodiments of the present disclosure may be applied to nearly any type of existing menu. For example, certain embodiments of the present disclosure may be used with paper, plastic, cardboard, leather, fabric, synthetic fiber, and/or metallic menus of different shapes and sizes, or the like.

FIG. 1 depicts a front view of a menu vision aid in accordance with embodiments of the present disclosure. In accordance with embodiments of the present disclosure, a menu vision aid 100 may generally comprise a frame 106, a lens 104, a light source 102, and an attachment member 120. Although depicted in FIG. 1 a generally rectangular shape, the vision aid 100 may comprise any shape suitable for embodiments of the present disclosure. Alternative relative positions of the frame 106, lens 104, light source 102 and attachment member 120 are also contemplated by and within embodiments of the present disclosure. The lens 104 may generally be disposed within the frame 106 and may be adapted to enhance the visibility of a menu page. The light source 102 may generally be attached to the frame 106 and may be adapted to provide light to a menu page. The attachment member 120 may generally be attached to at least one of the frame 106 and the light source 102, and may be adapted to attach the vision aid 100 to a menu page.

In exemplary embodiments, the frame 106 may be adapted to support at least the lens 104, the light source 102, and the attachment member 120. The frame 106 may include materials of sufficient strength to resist breaking when dropped from an approximate height range of 2 feet to 12 feet. By way of example, the frame 106 may comprise plastic, wood, metal, and/or the like. Although the portion of the frame 106 supporting the lens 104 is depicted as generally square in FIG. 1, this portion of the frame 106 may comprise any shape suitable for use with the present disclosure. For example, the portion of the frame 106 supporting the lens 104 may comprise a circle, triangle, parallelogram, pentagon, hexagon, or the like. Alternatively, the portion of the frame 106 supporting the lens 104 may comprise a free-form shape, such as the shape of an object, animal, cartoon character, or the like. The frame 106 may include a first vertical extension 126 and a second vertical extension 128 that may support the light source 102 via a first rod 111 and a second rod 112. The first vertical extension 126 and second vertical extension 128 may generally extend from at least a portion of the frame 106 and may be parallel with each other for supporting the light source 102. For example, the vertical extensions 126, 128 may extend from opposing sides of the frame 106. The vertical extensions 126, 128 may be detachable. The rods 111, 112 may comprise a material adapted to support the weight of the light source 102. For example, the rods 111, 112 may comprise metal, wood, and/or plastic, or the like.

The light source 102 may generally be attached to the frame 106 and may be adapted to provide light to a menu page. The light source 102 may also be detachable. The light source 102 may comprise a housing 103, a light 108, a power switch 118, and a power source (not shown). The housing 103 may be adapted to support the light 108 and attach to the frame 106. The housing 103 may comprise a top side 114, a bottom side 116, a first lateral side 113, and a second lateral side 115. The top side 114 may comprise a recessed portion 110 adapted to house the light 108 in a location recessed from the top side 114 to prevent damaging the light 108 when the top side 114 comes into contact with an object or surface. The recessed portion 110 may generally comprise a concave shape. The housing 103 may be supported between the vertical extensions 126, 128 of the frame 106 by a first rod 111 and a second rod 112. The rods 111, 112 may be seated within a portion of the lateral sides 113, 115 of the housing 103 on one end, and may be seated within a portion of the vertical extensions 126, 128 on an opposite end. The rods 111, 112 may support the light source 102 and allow the light source 102 to rotate about the rods 111, 112, so that the light 108 may be directed at a specific portion of a menu page.

The light 108 may be disposed on the top side 114 of the housing 103. The light 108 may comprise any lighting means suitable for embodiments of the present disclosure. By way of example, the light 108 may comprise a light emitting diode and/or an incandescent bulb, or the like. The light 108 may comprise any color. The brightness of the light 108 may be incrementally adjustable or selected from predetermined levels. The light 108 may be coupled with a power source adapted to provide power to the light. The power source may comprise a rechargeable source, which may be non-rechargeable or rechargeable, for example, with solar power. The power source may comprise a battery. The housing 103 may include a power switch 118 adapted to activate the power source disposed within the housing 103. The power switch 118 may be a switch, a button, remote controlled activator, or the like. The light 108 may be adapted to provide light to a menu page to enable a user to read and/or view the content of the menu page.

The lens 104 may generally be disposed within the frame 106 and may be adapted to enhance the visibility of a menu page. The lens 104 may comprise a convex lens that may be adapted to magnify at least a portion of a menu page. The lens 104 may comprise any size suitable for covering at least a portion of a menu page. For example, the lens may comprise a size covering the range of 1% to 100% of the surface area of the menu page. The lens 104 may comprise any shape suitable for use with embodiments of the present disclosure. The lens 104 may comprise any color suitable for use with embodiments of the present disclosure. The lens 104 may be prescription strength. The lens 104 may comprise varying degrees of magnification and/or visual enhancement. Although one lens 104 is depicted in FIG. 1, interchangeable or multiple lenses and bifocals are contemplated by and within embodiments of the present disclosure.

Figure 2:
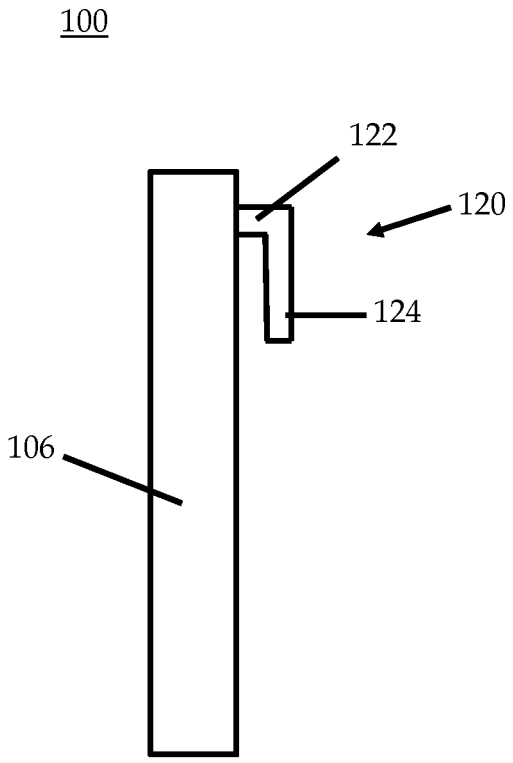
FIG. 2 depicts a side view of a menu vision aid in accordance with embodiments of the present disclosure.

The attachment member 120 may generally be attached to at least one of the frame 106 and the light source 102, and may be adapted to attach the vision aid 100 to a menu page. An alternative view of the attachment member 120 may be seen in FIG. 2. FIG. 2 depicts a side view of a menu vision aid 100 in accordance with embodiments of the present disclosure. The attachment member 120 may comprise a vertical support 122 and a horizontal support 124 for attaching the vision aid 100 to a menu page. The vertical support 122 may be adapted to fit on an edge of a menu page, substantially restricting movement of the vision aid 100 in a first direction. The horizontal support 124 may be adapted to fit on a back side of a menu page, substantially restricting movement of the vision aid 100 in a second direction, which may be substantially perpendicular to the first direction. The supports 122, 124 may be flexible and/or adjustable, so that they can adapt to different sized menu pages. The supports 122, 124 may comprise a clip biased in a closed position, so that when the clip is opened the vision aid 100 is secured on the menu page by the biasing force. The attachment member 120 may also be adapted to couple with a fastening member attached to a menu page.

In exemplary embodiments, the attachment member 120 may comprise a means of sliding across the surface of a menu page, such as with bearings or wheels (not shown). The attachment member 120 may also be adapted to couple with a fastening member, which may comprise a track allowing the vision aid 100 to slide across the surface of a menu page. Although depicted as a clip in FIG. 2, alternative attachment members 120 are contemplated by and within embodiments of the present disclosure. For example, magnetic fasteners, hook/loop fasteners, snaps, buttons, zippers, or the like are contemplated. The attachment member 120 may attach to the frame 106 and/or the housing 103 of the light source 102. The attachment member 120 may also be detachable from the frame 106 and/or the housing 103.

Figure 3:
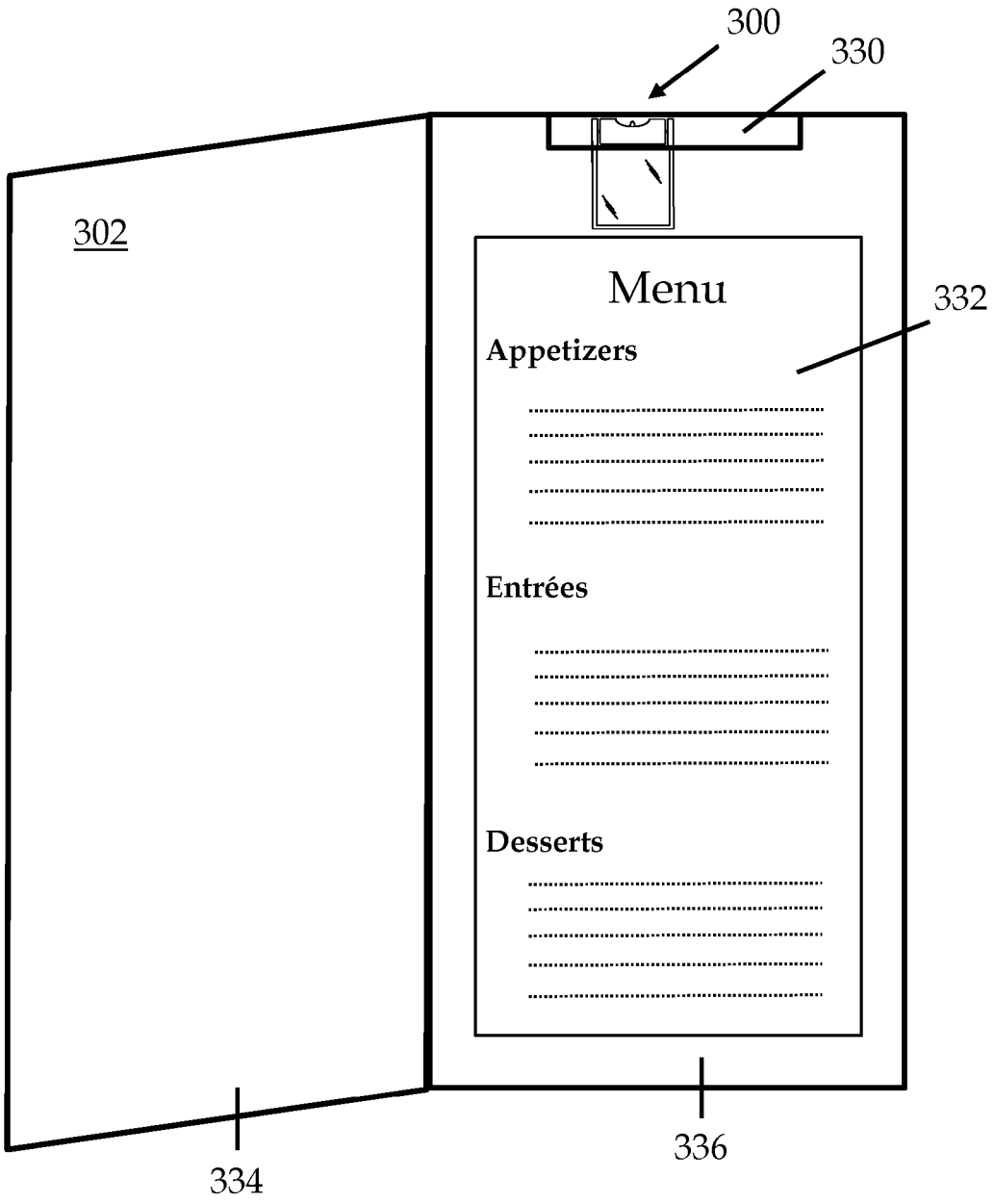
FIG. 3 depicts a perspective front view of a menu and a menu vision aid in accordance with embodiments of the present disclosure.

Referring now to FIG. 3, a perspective front view of a menu 302 and a menu vision aid in accordance with embodiments of the present disclosure. In exemplary embodiments, the menu 302 may comprise a fastening member 330, a vision aid 300, a first page 334, a second page 336, and a menu insert 332. The vision aid 300 is described herein with respect to the vision aid 100 of FIG. 1 and FIG. 2. Although depicted with two menu pages 334, 336 an alternative number of pages may be used. For example, 1, 3, 4, 5, or 6 pages may be used, or any number of pages that may be required to list the offerings of a business. The menu pages 334, 336 may comprise a hard backed folder and a menu insert 332, or a more flexible material with the menu offerings printed thereon. The flexible material may be formed out of laminated paper, plastic, paper, fiberboard, and/ or the like. In exemplary embodiments, the fastening member 330 may be adapted to couple with a portion of the vision aid 300. For example, the fastening member 330 may be adapted to couple with an attachment member of the vision aid 300.

Figure 4:
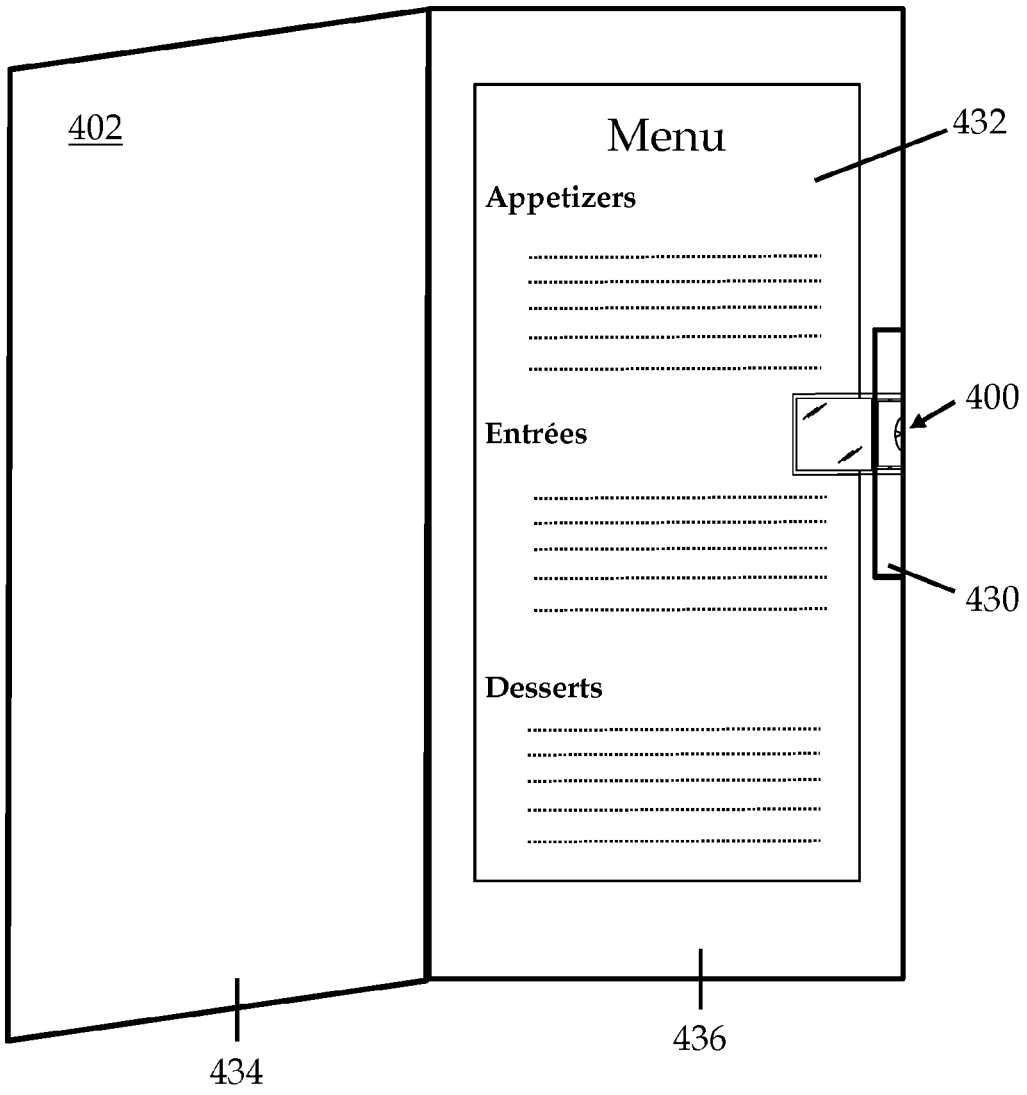
FIG. 4 depicts a perspective front view of a menu and a menu vision aid in accordance with embodiments of the present disclosure.

The fastening member 330 may comprise any attachment means suitable for attachment to the vision aid 300. By way of example, the fastening member 330 may comprise a track for allowing the vision aid 300 to slidably move across the surface of a menu page. The track may be flush with the menu page or may be recessed to a degree suitable for embodiments of the present disclosure. In alternative exemplary embodiments, the fastening member 330 may comprise a magnet or ferromagnetic material. In another embodiment, the fastening member 330 may comprise a track for securing the vision aid 300 in a single location. In yet another embodiment, the fastening member 330 may comprise a pocket or a strap adapted to receive the vision aid 300. The fastening member 330 may comprise a size suitable for use with embodiments of the present disclosure. By way of example, the fastening member 330 may comprise a length and/ or width in the range of 1% to 100% of the length and/or width of the menu. The fastening member 330 may be disposed on any location on a menu page, for example on the top, bottom, sides or center of the page. FIG. 4 depicts the fastening member 330 in a different location.

Referring now to FIG. 4, a perspective front view of a menu 402 and a menu vision aid in accordance with embodiments of the present disclosure. The vision aid 400, menu 402, fastening member 430, menu insert 432, first page 434, and second page 436 depicted in FIG. 4 are described with respect to the vision aid 300, menu 302, fastening member 330, menu insert 332, first page 334, and second page 336 depicted in FIG. 3. In addition, the fasting member 430 is depicted in an alternative location in FIG. 4. In exemplary embodiments, the fastening member 430 may be disposed on the side surface of a menu page. The fastening member 430 may comprise any size suitable for use with embodiments of the present disclosure. By way of example, the fastening member 430 may comprise a length and/ or width in the range of 1% to 100% of the length and/or width of the menu. In alternative embodiments, the vision aid 400 may be attached directly to a portion of the menu page, and a fastening member 430 may not be used. Although one fastening member 330, 430 is depicted in FIG. 3 and FIG. 4, two or more fastening members may be included to allow the vision aid 300, 400 to be supported in different locations on the menu 302, 402.

Figure 5:
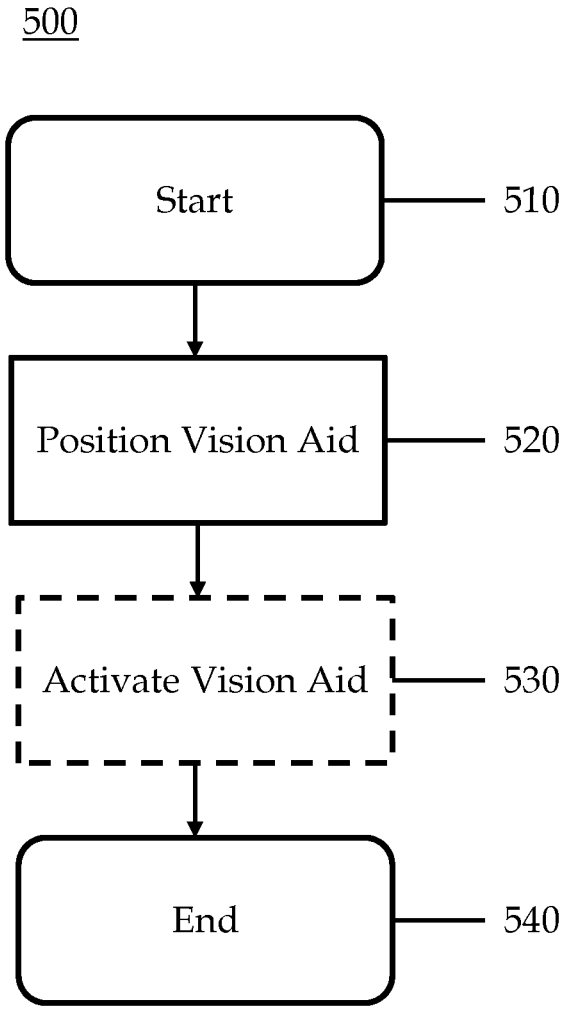
FIG. 5 depicts a flowchart of a method of using a menu vision aid in accordance with embodiments of the present disclosure.

FIG. 5 depicts a flowchart of a method of using a menu vision aid and viewing a menu in accordance with embodiments of the present disclosure. In accordance with embodiments of the present disclosure, a method of using a vision aid, such as the examples disclosed herein with respect to FIG. 1-FIG. 4, and viewing a menu, is provided. In embodiments, such a menu vision aid may generally comprise a frame, a lens, a light source, and an attachment member. For convenience, the method 500 of FIG. 5 is described with reference to the vision aid 100 and menu 302 described hereinabove with respect to FIG. 1 and FIG. 3. The method 500 may be carried out using other embodiments as well. At step 510, the method begins and a menu vision aid 100 in accordance with embodiments of the present disclosure is provided.

At step 520, the vision aid 100 is positioned on a menu page 334, 336. The vision aid 100 may be positioned over a portion of the menu page 334, 336 for enhancing the visibility of the portion, or may be attached to a fastening member 330 or a portion of the menu page 334, 336. If the vision aid 100 is positioned over a portion of the menu page 334, 336, and not attached to the fastening member 330 the user may hold the vision aid 100 by hand and view the visually enhanced portion of the menu page 334, 336 through the lens 104 of the vision aid 100. If the vision aid 100 is attached to a portion of the menu page 334, 336 or to a fastening member 330, the vision aid may be secured to a stationary position or may be movable across the fastening member 330 or menu page 334, 336. By way of example, if the fastening member 330 comprises a track, the vision aid 100 may be slidably movable across along the track and across the surface of a menu page 334, 336. If a light source 102 is included, the light source 102 may be positioned so that the light 108 is directed at a portion of the menu the user wishes to view, which may be the same portion viewable through the lens 104 of the vision aid 100.

After the vision aid 100 is positioned, the light source 102 may be activated at optional step 530. If the surrounding lighting in the area of the menu is insufficient, the user may decide to activate the light source 102. If the surrounding lighting in the area of the menu is sufficient, the user may decide that activating the light source 102 is not necessary, and the method may proceed to step 540. If the user decides to activate the light source 102, the user may turn on the light switch 118 or any means for activating the light source 102 in accordance with embodiments of the present disclosure. The user may then determine if the light 108 has provided sufficient lighting to the menu 302. If the light 108 has not provided sufficient lighting to the menu 302, the light source 102 may be repositioned. For example, the light source 102 may be rotated about the rods 111, 113 so that the light 108 provides adequate lighting to the menu 302. If the user decides the light 108 has provided sufficient lighting to the menu 302, and the user has viewed the desired portion of the menu page 334, 336, the method ends at step 540, where the vision aid 100 may be secured to the menu page 334, 336 for storage or removed from the menu page 334, 336 for transportation.

It should be emphasized that the above-described embodiments of the present disclosure are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

Now that exemplary embodiments of the present disclosure have been shown and described in detail, various modifications and improvements thereon will become readily apparent to those skilled in the art.

It will be understood that one or more of the steps described can be rearranged, separated, and/or combined without deviating from the scope of embodiments of the disclosure. For ease, steps are, at times, presented sequentially. This is merely for ease and is in no way meant to be a limitation.

Further, it will be understood that one or more of the elements and/or exemplary embodiments of the disclosure described can be rearranged, separated, and/or combined without deviated from the scope of the disclosure. For ease, various elements are described, at times, separately. This is merely for ease and is in no way meant to be a limitation.

While the various steps, elements, and/or exemplary embodiments of the disclosure have been outlined above, it is evident that many alternatives, modifications and variations will be apparent to those skilled in the art. The various steps, elements, and/or exemplary embodiments of the disclosure, as set forth above, are intended to be illustrative, not limiting. Various changes can be made without departing from the spirit and scope of the disclosure. Accordingly, the spirit and scope of the present disclosure is to be construed broadly and not limited by the foregoing specification.

No element, act, or instruction used in the description of the present application should be construed as critical or essential to the disclosure unless explicitly described as such. Also, as used herein, the article "a" is intended to include one or more items. Where only one item is intended, the term "one" or similar language is used.

Further, the terms any of followed by a listing of a plurality of items and/or a plurality of categories of items, as used herein, are intended to include "any of," "any combination of," "any multiple of," and/or "any combination of multiples" of the items and/or the categories of items, individually or in conjunction with other items and/or other categories of items. In addition, as used herein, the term "set" is intended to include any number of items, including zero. Further, as used herein, the term "number" is intended to include any number, including zero.

What is claimed is:

1. A menu vision aid comprising:
- a frame;
- a planar convex lens disposed within the frame adapted to magnify and enhance the visibility of a menu page;
- a light source attached to the frame adapted to provide light to a menu page; and
- an attachment member attached to at least one of the frame and the light source, the attachment member for removably attaching the menu vision aid to a menu page.

2. The menu vision aid of claim 1, wherein the light source comprises:
- a housing having a top side, a bottom side, a first lateral side and a second lateral side;
- a light disposed on the top side of the housing; and
- a power source coupled with the light for providing power to the light, the power source disposed within the housing.

3. The menu vision aid of claim 2, wherein the light comprises a light emitting diode.

4. The menu vision aid of claim 2, wherein the light comprises an incandescent bulb.

5. The menu vision aid of claim 2, wherein at least a portion of the top side of the housing is concave.

6. The menu vision aid of claim 2, further comprising:
- a first vertical extension extending from the first lateral side of the frame;
- a first rod extending between the first vertical extension and the first lateral side of the housing;
- a second vertical extension extending form the second lateral side of the frame;
- a second rod extending between the second vertical extension and the second lateral side of the housing;
- wherein the first rod and the second rod are adapted to support the housing between the first vertical extension and the second vertical extension; and
- wherein the first rod and the second rod are adapted to allow the housing to rotate about the first rod and the second rod.

7. The menu of claim 2, wherein the power source is a battery.

8. The menu vision aid of claim 1, wherein the attachment member comprises a clip.

9. The menu vision aid of claim 1, wherein the attachment member comprises a magnet.

10. A menu comprising:
- a menu page;
- a fastening member secured to the menu page; and
- a vision aid attached to the fastening member, the vision aid comprising:
  - a frame;
  - a planar convex lens disposed within the frame adapted to magnify and enhance the visibility of a menu page;
  - a light source attached to the frame adapted to provide light to the menu page; and
  - an attachment member attached to at least one of the frame and the light source, the attachment member adapted to removably attach the menu vision aid to the fastening member.

11. The menu of claim 10, wherein the attachment member is attached to at least one of the light housing and the frame.

12. The menu of claim 10, wherein the attachment member comprises a clip.

13. The menu of claim 12, wherein the fastening member is a slot adapted to receive the clip.

14. The menu of claim 10, wherein the attachment member comprises a magnet.

15. The menu of claim 14, wherein the fastening member comprises a ferromagnetic material.

16. The menu of claim 10, wherein the fastening member comprises a track, and wherein the attachment member is adapted to couple with the track and slidably move along a surface of the menu page.

17. A method for viewing a menu comprising:
- providing menu vision aid comprising:
  - a frame;
  - a planar convex lens disposed within the frame adapted to magnify and enhance the visibility of a menu page;
  - a light source attached to the frame adapted to provide light to a menu page; and
  - an attachment member attached to at least one of the frame and the light source, the attachment member adapted to removably attach the menu vision aid to a menu page;
- attaching the menu vision aid to a menu page and positioning the lens over at least a portion of the menu page; and
- viewing the menu.

18. The method of claim 17, further comprising:
- activating the light source.

19. The method of claim 18, further comprising:
- removing the menu vision aid from the menu page.

* * * * *